US005123204A

United States Patent [19]

He

[11] Patent Number: 5,123,204

[45] Date of Patent: Jun. 23, 1992

[54] AUTOMATIC DOOR CONTROL APPARATUS

[76] Inventor: Shun C. He, No. 500, Ding Chou Rd., Taipei, Taiwan

[21] Appl. No.: 699,723

[22] Filed: May 14, 1991

[51] Int. Cl.[5] ..... E05F 15/10

[52] U.S. Cl. ..... 49/334; 49/139

[58] Field of Search ..... 49/334, 139, 140

[56] References Cited

U.S. PATENT DOCUMENTS

| | | | |
|---|---|---|---|
| 2,108,328 | 2/1938 | Carnahan | 49/334 |
| 3,996,697 | 12/1976 | Bailey et al. | 49/139 X |
| 4,098,023 | 7/1978 | Slopa | 49/139 |
| 4,186,521 | 2/1980 | Hunter | 49/334 X |
| 4,735,018 | 4/1988 | Duncan et al. | 49/139 X |

FOREIGN PATENT DOCUMENTS

| | | | |
|---|---|---|---|
| 329332 | 11/1920 | Fed. Rep. of Germany | 49/334 |

*Primary Examiner*—Philip C. Kannan

*Attorney, Agent, or Firm*—Bacon & Thomas

[57] ABSTRACT

An apparatus for controlling the opening and closing of an automatic door. The apparatus includes an L-shaped housing having a first portion disposed below ground level for housing a speed reduction mechanism and a second portion disposed above ground level and positioned behind a door post for housing a motor and control mechanism. The speed reducing mechanism includes a gear train to provide a desired reduced motor speed and the control mechanism is driven by the motor in synchronism with the speed reducing mechanism to control the opening and closing angle of the door.

3 Claims, 2 Drawing Sheets

AUTOMATIC DOOR CONTROL APPARATUS

FIELD OF THE INVENTION

The present invention generally relates to the field of technology pertaining to automatic door control apparatus, and particularly to an improved apparatus provided with a motor which drives a speed reduction mechanism and a control mechanism in synchronism.

BACKGROUND OF THE INVENTION

Generally, automatic doors have several types of known control apparatus, including the double-rail or mono-rail reciprocal type driven by a chain and sprocket, the double-rail or mono-rail rotational type driven by a rack and pinion, and the rotational type driven by pair of bevel gears and a swinging arm.

Specifically, there are two types of automatic door control apparatus which are considered related to the present invention. The first type has its motor and speed reducing mechanism disposed in a door post to facilitate maintenance, but this type of apparatus is difficult to install. The second type has its motor and speed reducing mechanism disposed under ground level, but this type of apparatus is easily damaged by moisture.

SUMMARY OF THE INVENTION

It is an object of the present invention to provide a control apparatus for an automatic door whereby the apparatus overcomes the disadvantages found in conventional control apparatus of the same type.

It is another object of the present invention to provide a control apparatus for an automatic door wherein the apparatus includes an L-shaped housing for accommodating a motor, a speed reduction mechanism and a control mechanism.

Other objects, features and advantages of the invention will become apparent from the following detailed description of a preferred embodiment thereof, when considered in conjunction with the drawings wherein like reference characters refer to corresponding parts in the several views.

DETAILED DESCRIPTION OF THE PREFERRED EMBODIMENT

Figure 1:
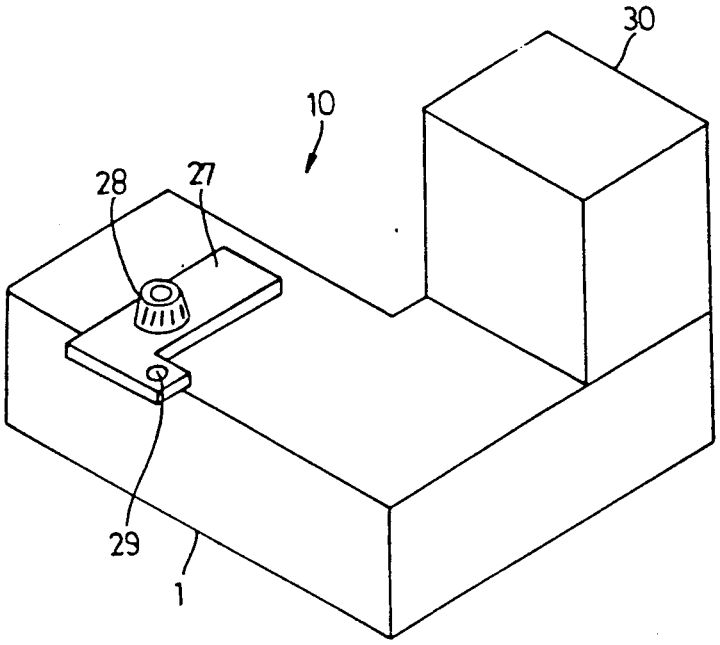
FIG. 1 is a perspective view of a control apparatus according to a preferred embodiment of the invention.
Figure 2:
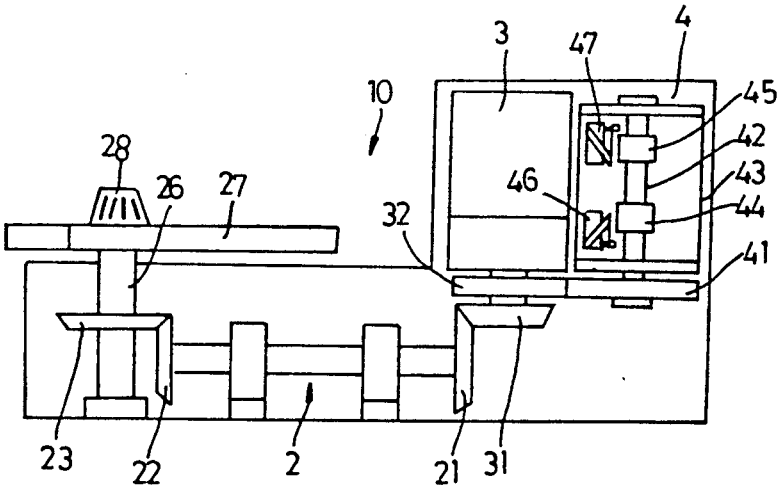
FIG. 2 is a front elevational sectional view showing the speed reduction mechanism and the control mechanism disposed within the L-shaped housing.

With initial reference to FIGS. 1 and 2 of the drawings, there is depicted a control apparatus 10 according to a preferred embodiment of the invention. Apparatus 10 includes an L-shaped housing 1 for accommodating a speed reduction mechanism 2 and a control mechanism 4.

Figure 3:
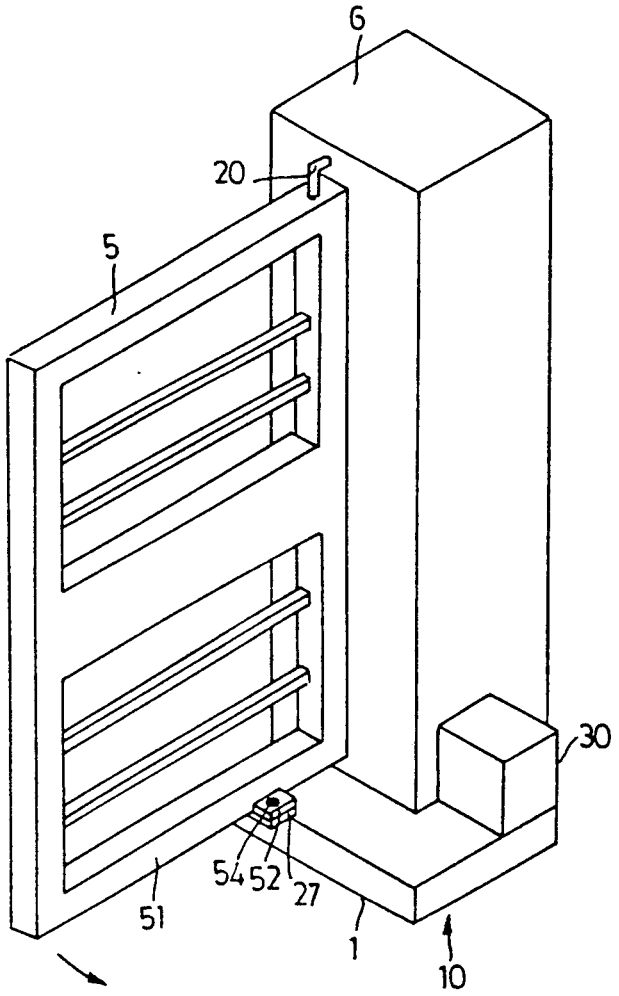
FIG. 3 is a perspective view showing the control apparatus of the invention installed on a door and post assembly.

Speed reduction mechanism 2 includes a first bevel gear 21 and a second bevel gear 22 mounted on the opposite ends of an output shaft which is in turn supported for rotation on a pair of bearing assemblies. Bevel gear 21 is engaged with an output gear 31 mounted on the output shaft of a motor 3, while bevel gear 22 is engaged with a third bevel gear 23, the latter being mounted on a main shaft 26 that includes an upper end which extends out of housing 1. This arrangement permits a preferred reduction of the rotating speed of shaft 26 to about 1 revolution per minute (RPM), so that a door 5, shown in FIG. 3, is caused to open or close slowly, as desired. As also apparent, speed reduction mechanism 2 is substantially entirely disposed within a first portion of housing 1.

As also seen in FIG. 2, the upper end of main shaft 26 extends outwardly above the first portion of housing 1 and is connected to an L-shaped oscillating arm 27 and capped by a conical-shaped ball bearing assembly 28. Door 5 is provided with a sleeve member (not shown) disposed at its bottom and in rotatable engagement with bearing assembly 28. When electric power is shut off or when control apparatus 10 malfunctions, door 5 is still permitted to be manually operated.

As seen in FIG. 3, aperture 29 is provided in oscillating arm 27 and a hole 52 is formed in a plate secured to the bottom of door 5. Aperture 29 and hole 52 are aligned for receiving a pin 54 therethrough. An upper pin 20 is provided on door 5 to define a pivot axis so that door 5 may pivot about such axis with the oscillating arm 27 in synchronism. However, pin 54 may be removed to disconnect the engagement of door 5 from control apparatus 10 in order to permit manual operation of door 5.

The opening and closing of an automatic door is often limited to a preset angle of rotation about the pivot axis of the door. Thus, oscillating arm 27 must be stopped in accordance with the preset angle. This is realized by control mechanism 4 which is housed in a second portion of housing 1 that extends upwardly from the first portion and is preferably disposed above ground level. Control mechanism 4 includes a driven gear 41 engaged with a driving spur gear 32, the latter also being mounted on the output shaft of motor 3. Gear 41 is mounted on an end of a screw shaft 42 which is in turn rotatably mounted on a frame member 43. Shaft 42 is provided with an upper slide 45 and a lower slide 44 mounted thereon for engaging respective upper and lower microswitches 47 and 46 to inactivate motor 3 when the door has reached the outer limits of the preset angle of rotation.

Figure 4:
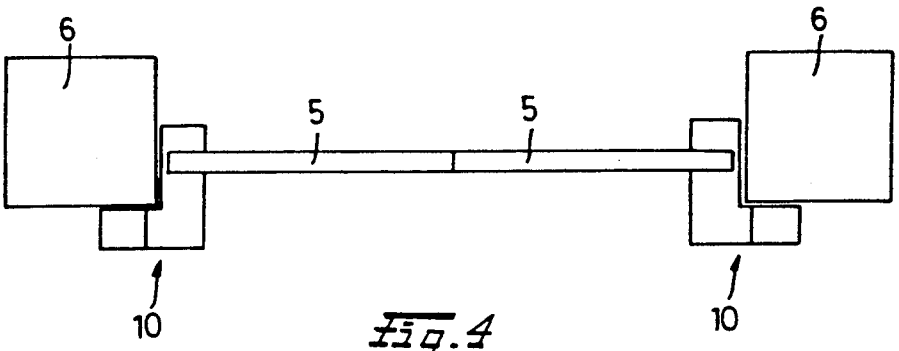
FIG. 4 is a top view showing the control apparatus of the invention installed on two door and post assemblies.

As further shown in FIGS. 3 and 4, control apparatus 10 is positioned close to a door post 6 and with the first portion of housing 1 being disposed below ground level. This permits oscillating arm 27 to be exposed for connection with the bottom of door 5 in the manner previously described herein. Motor 3 and control mechanism 4 are disposed in the second part of housing 1 which extends above ground level and is indicated at 30 in FIG. 3.

During operation of control apparatus 10, with door 5 in a closed position, motor 3 starts to drive speed reduction mechanism 2 which rotates main shaft 26 so that oscillating arm 27 can open door 5. Simultaneously, motor 3 also drives control mechanism 4 through driven gear 41 and screw shaft 42 to move slide 44 downwardly. When slide 44 engages microswitch 46, motor 3 is deactivated, thereby stopping the pivotal movement of door 5.

Similarly, during operation when door 5 is in an open position, motor 3 is activated in a reverse direction to cause oscillating arm 27 to close door 5. The driven gear 41 and the screw shaft 42 of control mechanism 4 are activated to move slide 45 upwardly into engagement with microswitch 47, thereby deactivating motor 3 and stopping the closing movement of door 5.

It is apparent that the preset angle of rotation through which door 5 may pivot between open and closed position can be predetermined through the gear ratio of driving gear 32, driven gear 41 and lead of screw shaft 42.

As disclosed herein, the present invention provides an improved control apparatus for the automatic opening and closing of a door wherein the apparatus includes a first portion disposable below the ground level for containing a speed reduction mechanism and a second portion disposable above the ground level for containing a motor and control mechanism. This arrangement conserves installation space and provides a compact and neat appearance. This arrangement further facilitates maintenance and prevents damage by moisture and possible electricity leak.

Various changes or modifications can be made to the invention by one of ordinary skill in the art and without departing from the spirit of the invention, and it is intended that all matter contained in the above description shall be interpreted as being merely illustrative and not in a limiting sense.

What is claimed is:

1. A control apparatus for an automatic door comprising:

a) an L-shaped housing including a first portion for disposition below ground level and a second portion extending upwardly from the first portion for disposition above ground level;

b) a motor disposed within the second portion of the housing and including an output shaft, and an output bevel gear and a driving spur gear secured to the output shaft;

c) a speed reduction mechanism disposed in the first portion of the housing and including a first bevel gear engaged with the output bevel gear of the motor, a horizontal shaft, rotatably mounted on bearing assemblies, connected at one end thereof to said first bevel gear, a second bevel gear connected at the other end of said horizontal shaft, a third bevel gear and a vertically extending main shaft including an upper end extending outwardly of the first portion of the housing, the third bevel gear being secured to the main shaft and disposed in engagement with the second bevel gear;

d) a control mechanism disposed in the second portion of the housing and including a screw drive shaft, a driven gear secured to the screw drive shaft and disposed in engagement with the driving spur gear of the motor to rotate the screw shaft, an upper slide and a lower slide mounted on the screw drive shaft for movement therealong, and a pair of microswitches for respective engagement by the upper and lower slides for inactivating the motor when the door has reached predetermined open and closed positions; and e) an oscillating arm mounted on the upper end of the main shaft and means carried by the oscillating arm for mounting a door thereon to define a pivot axis through which the door may be opened and closed at a predetermined speed and angle by the motor driving the speed reduction mechanism in synchronism with the control mechanism.

2. The control apparatus of claim 1 wherein the means for mounting a door on the oscillating arm includes;

a) a plate for attachment to the bottom of the door and a hole formed through the plate;

b) an aperture formed in the oscillating arm; and c) a pin insertable through the hole and aperture to connect the door to the oscillating arm.

3. The door control apparatus of claim 2 further including a conical-shaped bearing assembly secured to the upper end of the main shaft for rotatable engagement with the bottom of the door to permit manual operation of the door when the pin is removed from the hole and aperture.

* * * * *